US007802859B2

(12) United States Patent
Tyvoll et al.

(10) Patent No.: US 7,802,859 B2
(45) Date of Patent: Sep. 28, 2010

(54) REFILLING A USED INK CARTRIDGE

(75) Inventors: David A. Tyvoll, San Diego, CA (US); Winthrop D. Childers, San Diego, CA (US); David M. Hagen, Corvallis, OR (US); Douglas Hoffman, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 844 days.

(21) Appl. No.: 11/633,297

(22) Filed: Dec. 4, 2006

(65) Prior Publication Data

US 2008/0100681 A1 May 1, 2008

Related U.S. Application Data

(63) Continuation-in-part of application No. 11/589,526, filed on Oct. 30, 2006.

(51) Int. Cl.
*B41J 2/195* (2006.01)

(52) U.S. Cl. ..... 347/7

(58) Field of Classification Search ..... 347/7, 347/84–87

See application file for complete search history.

(56) References Cited

U.S. PATENT DOCUMENTS 5,704,403 A 1/1998 Schwenk et al.
5,798,771 A 8/1998 Nishii et al.
5,801,735 A 9/1998 Lorenze, Jr. et al.
6,024,429 A * 2/2000 Coffy et al. ..... 347/7
2008/0074479 A1 * 3/2008 Santos et al. ..... 347/85

FOREIGN PATENT DOCUMENTS

EP 0953450 11/1999
EP 1095779 5/2001

OTHER PUBLICATIONS

Invitation to Pay Additional Fees and Communication Relating to the Results of the Partial International Search Dated Mar. 7, 2008.

* cited by examiner

*Primary Examiner*—An H Do

(57) ABSTRACT

In one embodiment, a method for refilling a used ink cartridge includes determining a quantity of ink remaining in an ink holding chamber in the cartridge, determining a desired quantity of ink to refill the chamber based on a difference between a capacity of the chamber and the quantity of ink remaining in the chamber, and refilling the chamber with the desired quantity of ink. In another embodiment, a method for refilling a used ink cartridge includes introducing ink into an ink holding chamber in the cartridge, simultaneously with introducing ink into the chamber, monitoring the level of ink in the chamber, and ending the introduction of ink into the chamber when the level of ink in the chamber reaches a desired level.

14 Claims, 11 Drawing Sheets

REFILLING A USED INK CARTRIDGE

CROSS REFERENCE TO RELATED APPLICATIONS

This is a continuation-in-part of U.S. application Ser. No. 11/589,526 filed Oct. 30, 2006 entitled Introducing Ink Into An Ink Cartridge.

BACKGROUND

Refill kiosks are becoming popular with printer users for refilling used inkjet print cartridges. Inkjet print cartridges are also sometimes called ink cartridges, inkjet cartridges or ink pens. One factor that can affect the performance and use of a refill kiosk is the extent to which the cartridge can be accurately or completely filled. The amount of ink needed to completely fill a used cartridge depends on the amount of ink left in the cartridge. This leftover ink typically varies from cartridge to cartridge. One method currently used to control the accuracy of the fill level is to print or otherwise extract all of the ink from the used cartridge and then refill the cartridge, thus eliminating the varying amount of left over ink as a factor in the refill method. This method, however, adds undesirable labor costs and reduces automation of the refill method, and wastes ink.

DRAWINGS

Figure 9:
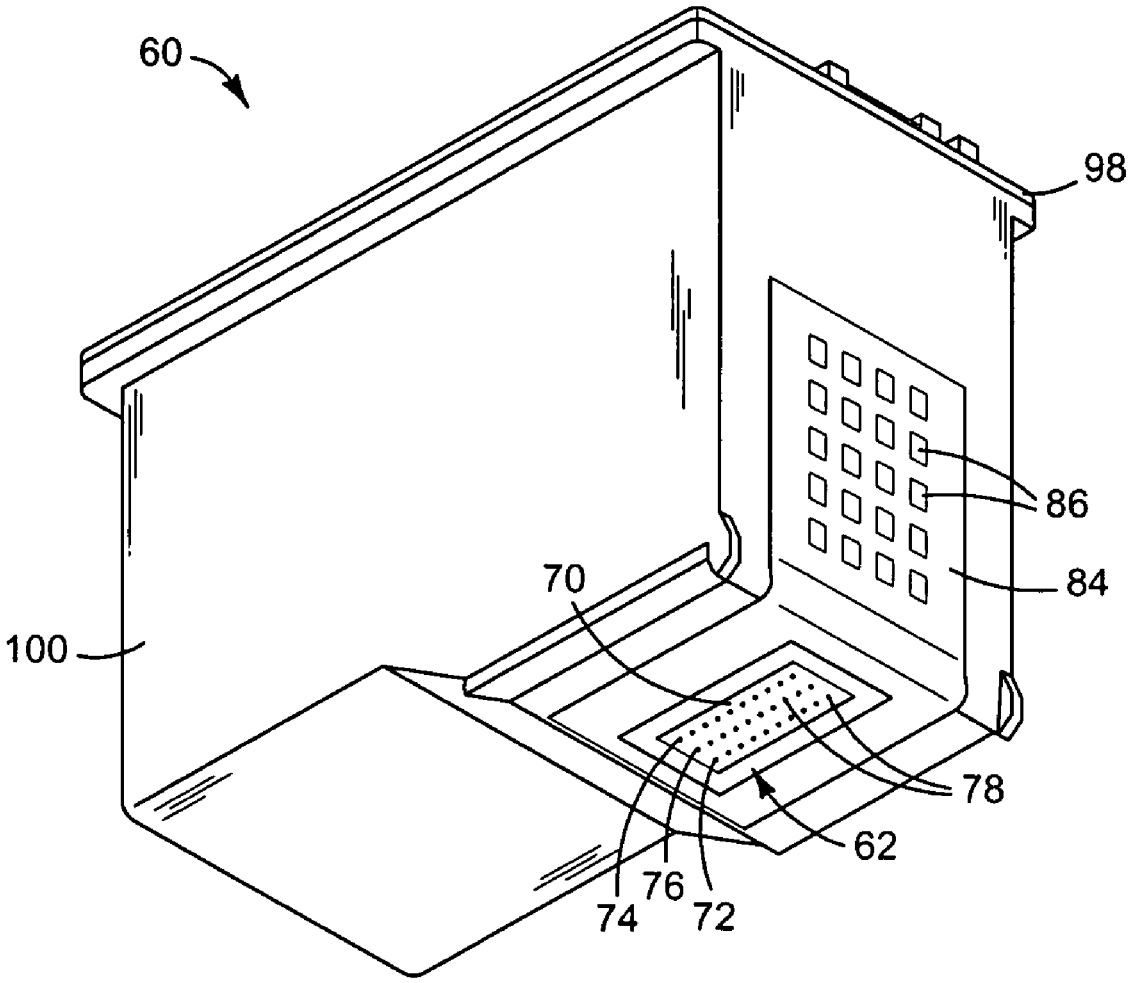
FIG. 9 is a perspective view illustrating a three-color ink cartridge.
Figure 11:
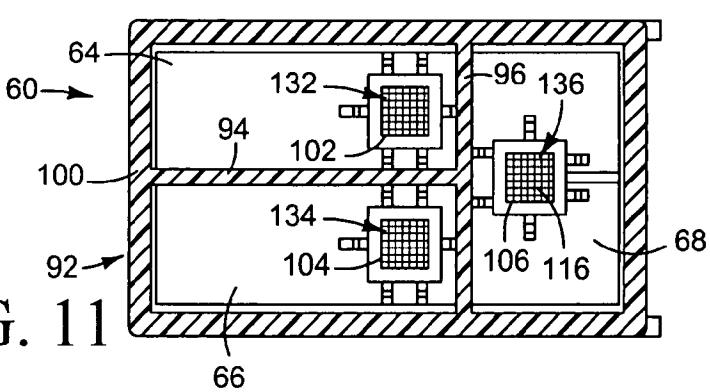
FIG. 11 is a plan section view of the ink cartridge of FIG. 9 taken along the line 11-11 in FIG. 12 with the ink holding foam omitted to more clearly illustrate some of the internal features of the ink cartridge.
Figure 14:
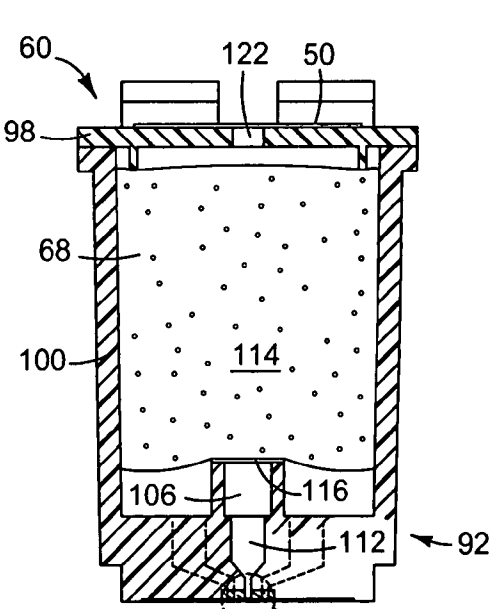
Figure 13:
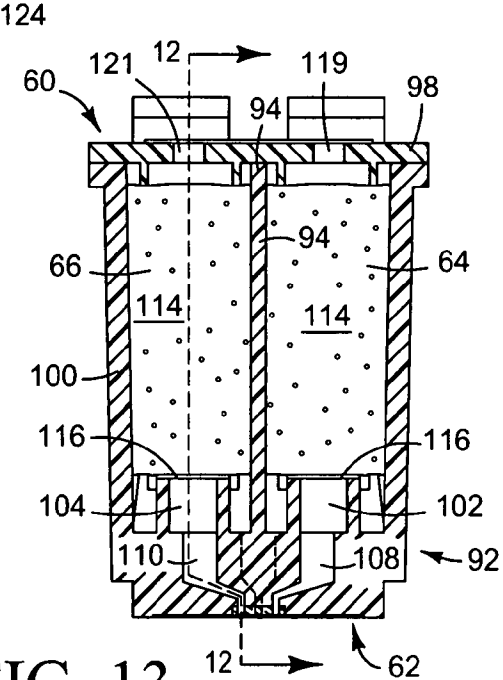
Figure 12:
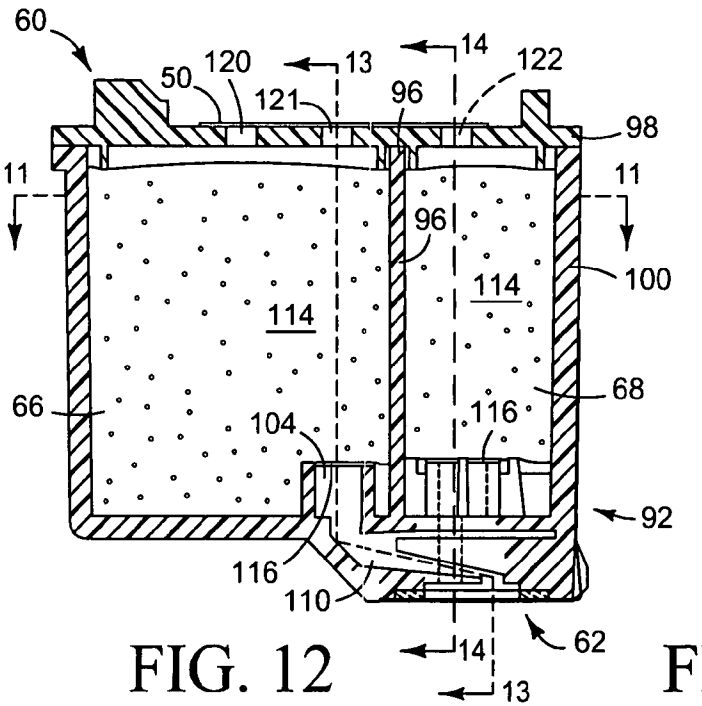
FIG. 12 is a side elevation section view of the cartridge of FIG. 9 taken along the line 12-12 in FIG. 13.

FIGS. 13 and 14 are front elevation section views of the ink cartridge of FIG. 9 taken along the lines 13-13 and 14-14 in FIG. 12.

Figure 15:
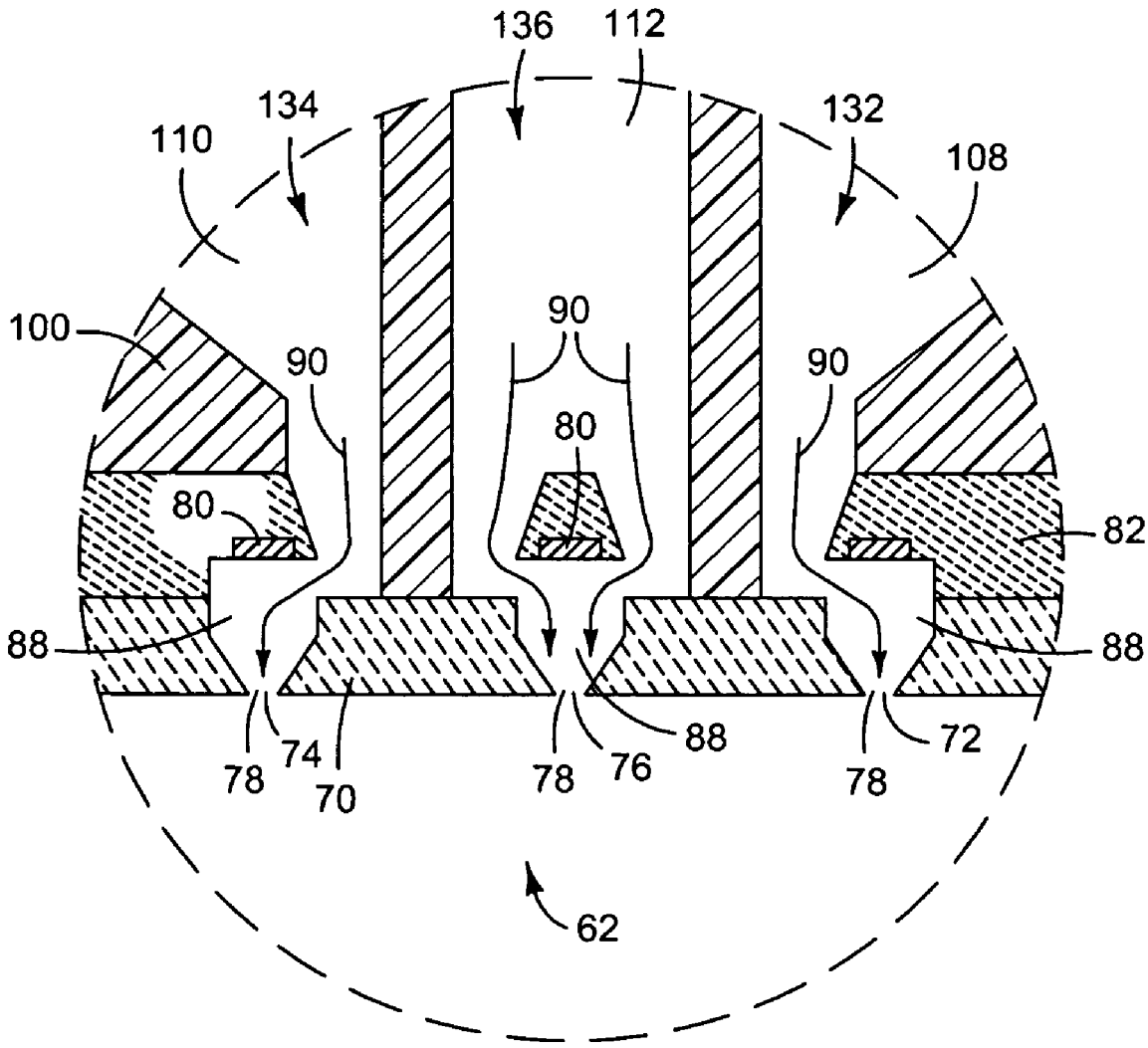

FIG. 15 is a detail section view taken from FIG. 14 of a portion of the printhead in the cartridge of FIG. 9.

Figure 17:
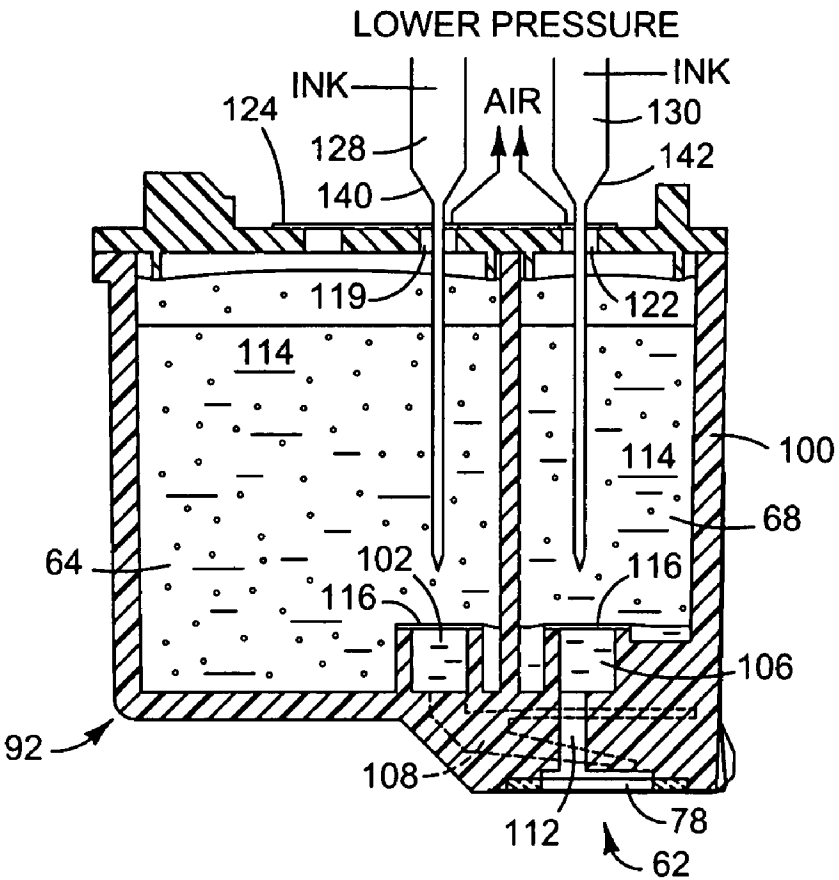
Figure 16:
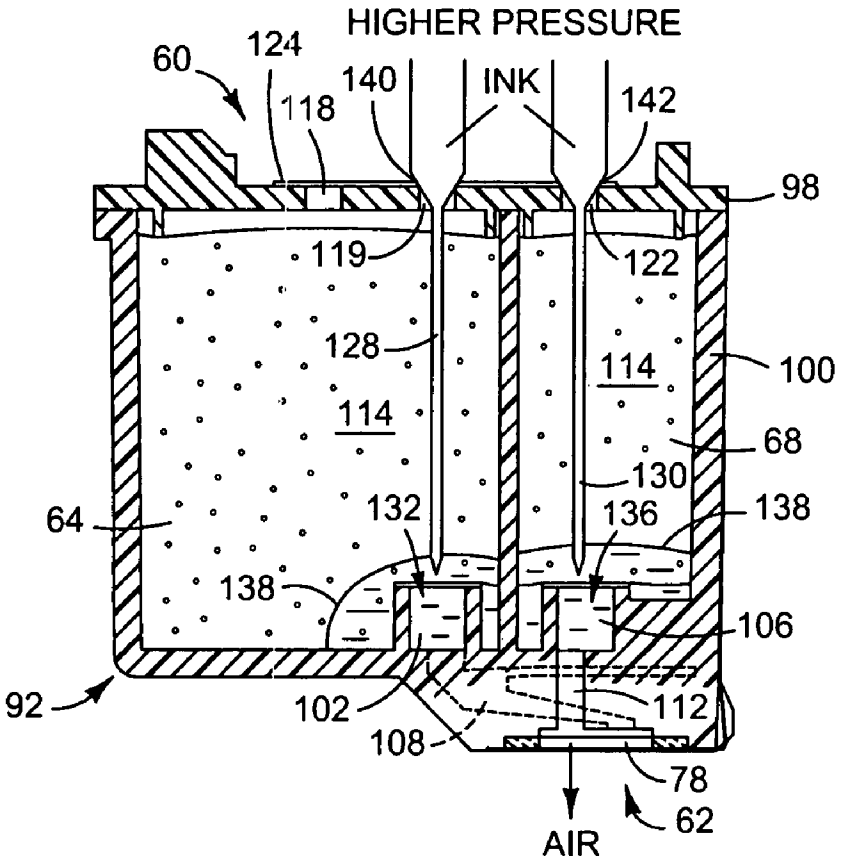

FIGS. 16 and 17 are side elevation section views of the cartridge of FIG. 9 illustrating a method according to an embodiment of the invention.

Figure 18:
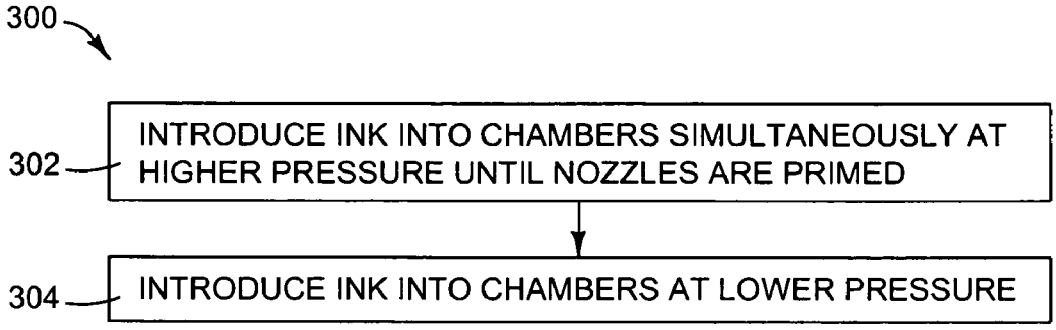

FIG. 18 is a flow chart illustrating an ink introduction method according to an embodiment of the invention.

Figure 19:
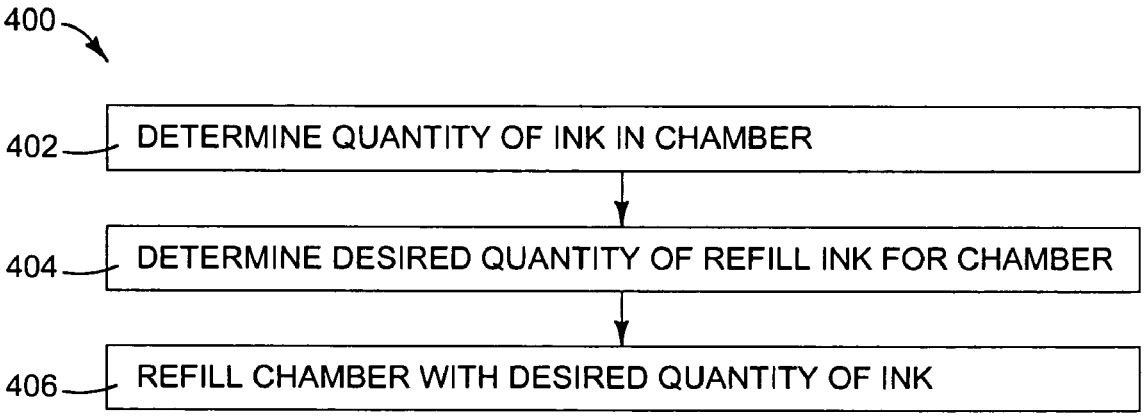

FIG. 19 is a flow chart illustrating a method for refilling a used ink cartridge according to an embodiment of the invention.

Figure 20:
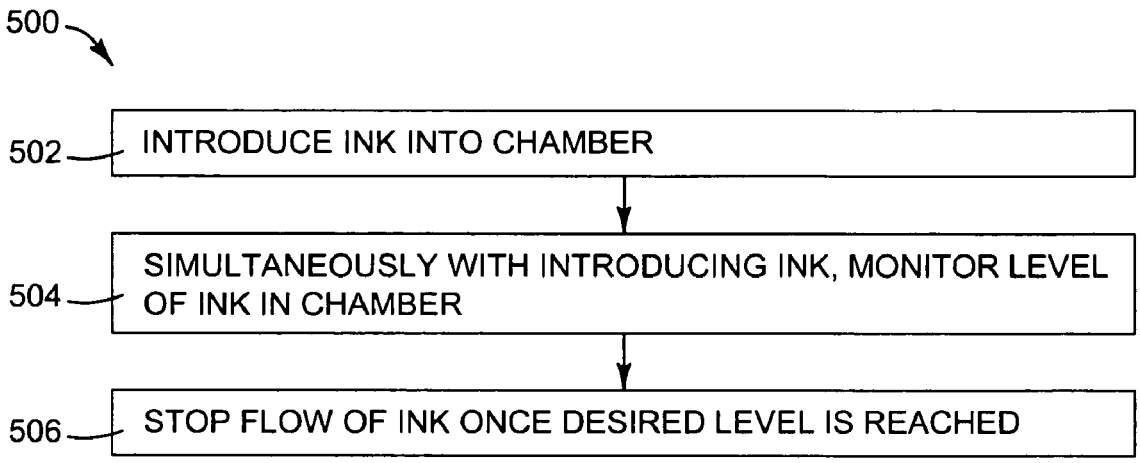

FIG. 20 is a flow chart illustrating a method for refilling a used ink cartridge according to an embodiment of the invention.

Figure 21:
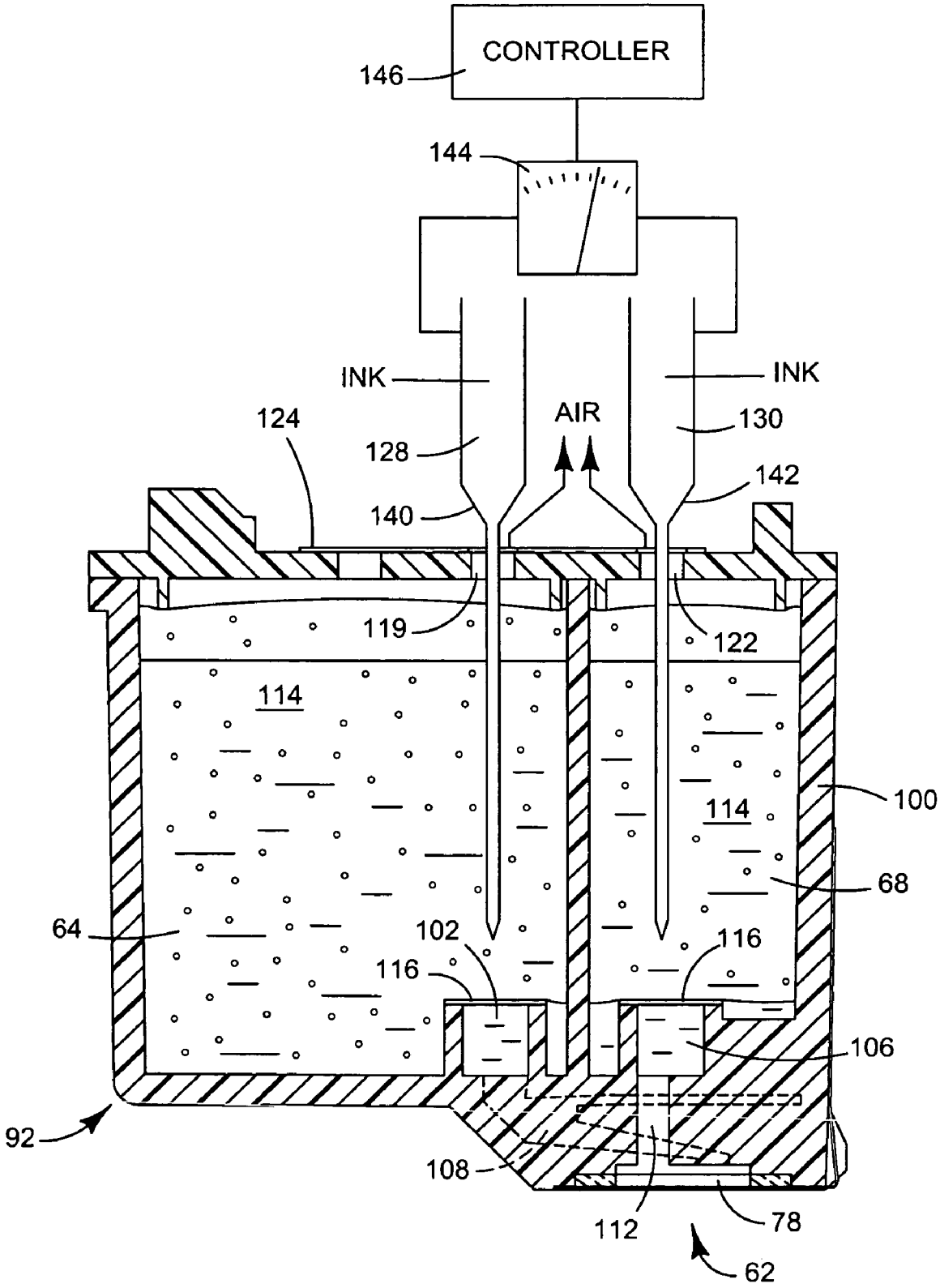

FIG. 21 is a side elevation section view of the cartridge of FIG. 9 illustrating a method according to an embodiment of the invention.

Figure 22:
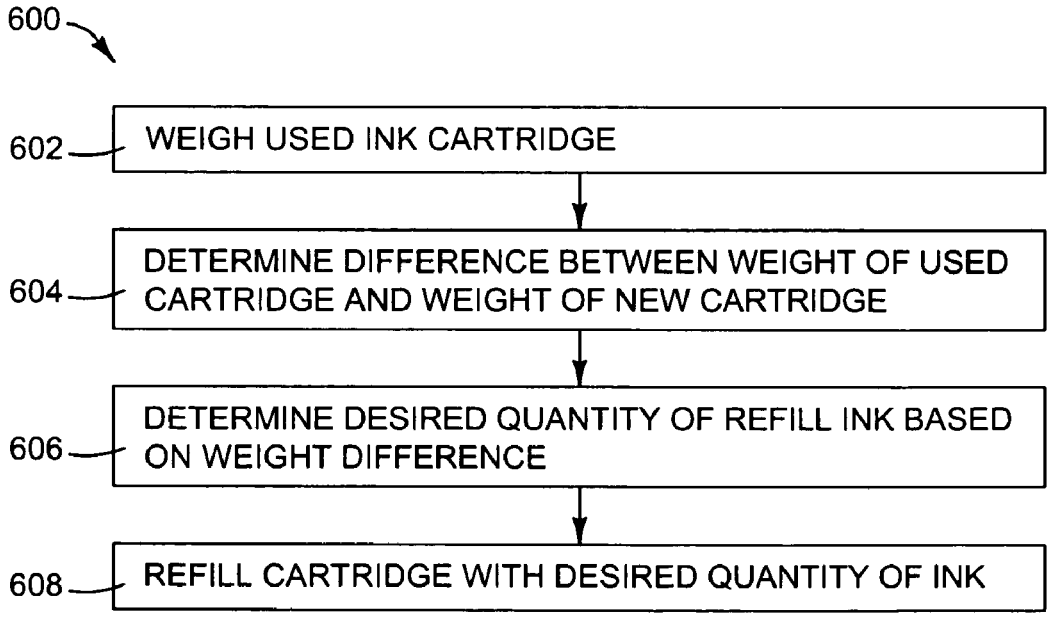

FIG. 22 is a flow chart illustrating a method for refilling a used ink cartridge according to an embodiment of the invention.

Embodiments of the new methods were developed in an effort to improve on conventional kiosk ink cartridge refill methods. Embodiments will be described, therefore, with regard to refilling a used ink cartridge. Embodiments of the new methods for determining ink levels, however, are not limited to use in refill kiosks, or for refilling used ink cartridges generally, but may also be used in any environment or application in which it might be desirable to use the new methods.

Figure 1:
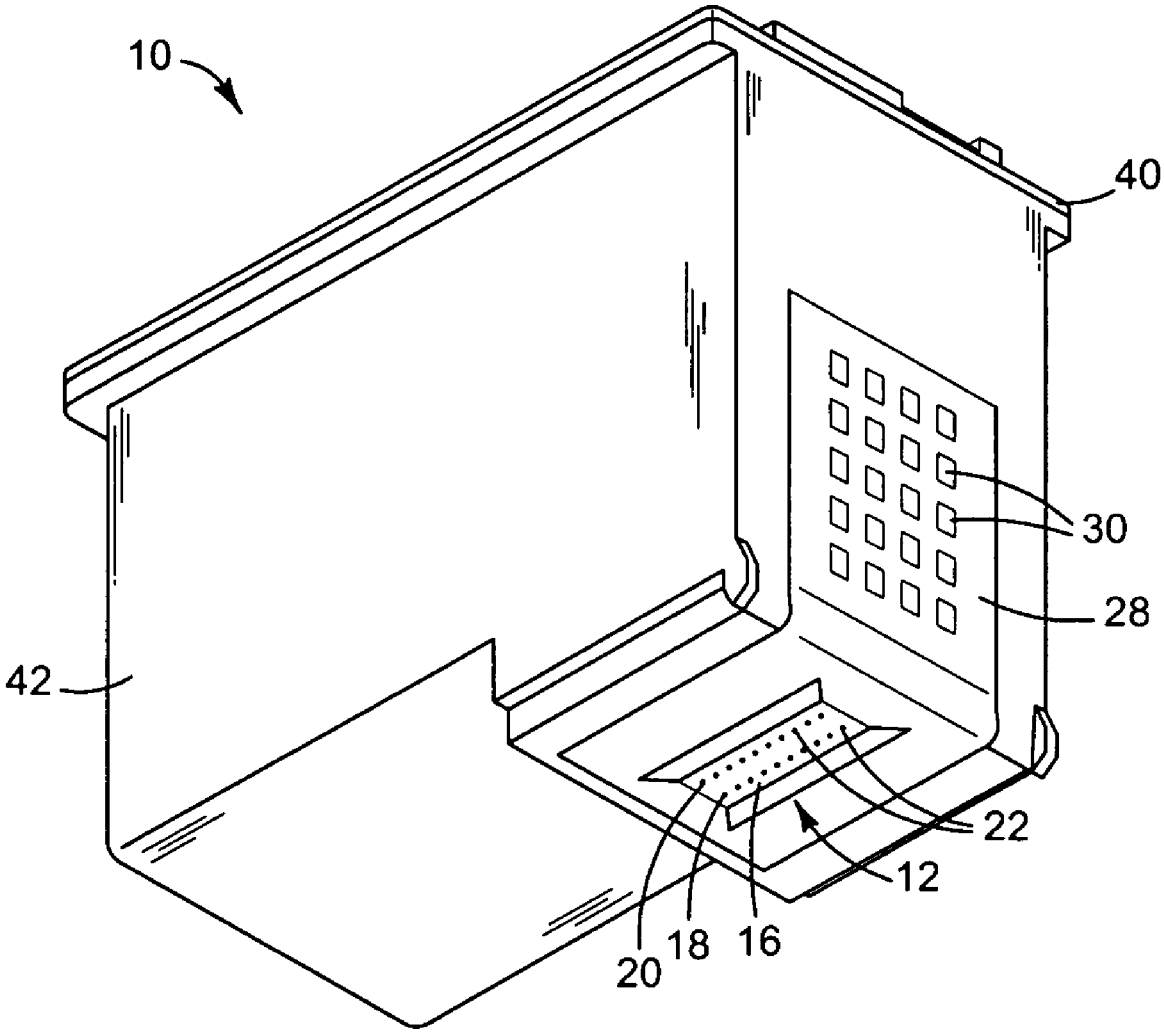
FIG. 1 is a perspective view illustrating a black or other single-color ink cartridge.
Figure 2:
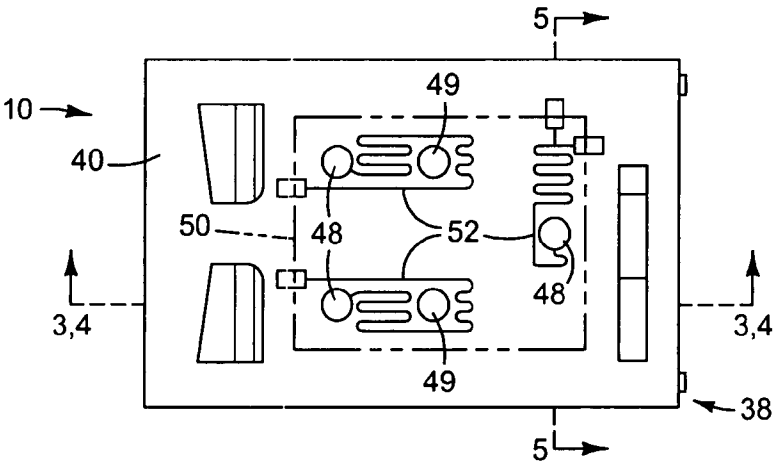
FIG. 2 is a top plan view of the ink cartridge of FIG. 1.
Figure 7:
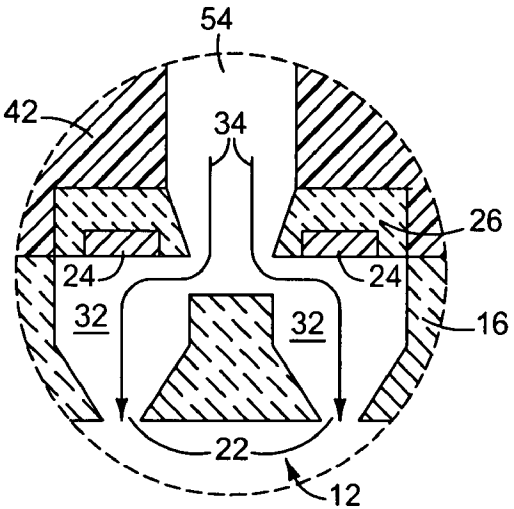
FIG. 7 is a detail section view taken from FIG. 5 of a portion of the printhead in the cartridge of FIG. 1.
Figure 5:
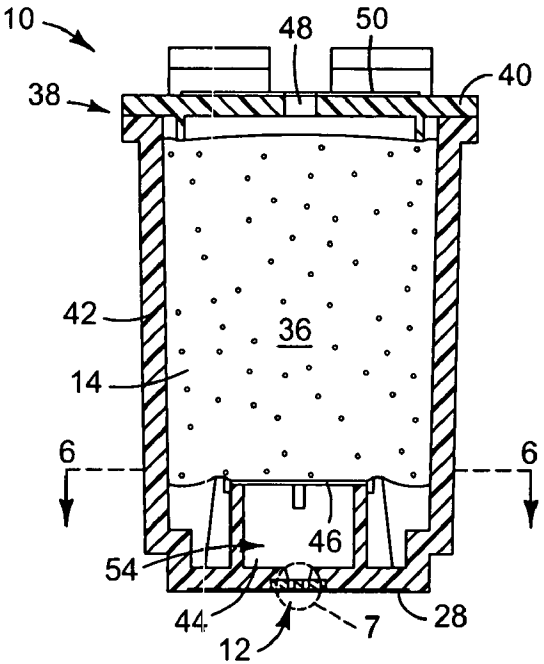
FIG. 5 is a front elevation section view of the ink cartridge of FIG. 1 taken along the line 5-5 in FIG. 2.

FIGS. 1-7 illustrate a single-color (typically black) ink cartridge 10 for a thermal inkjet printer. Embodiments of the invention might also be implemented with respect to an ink cartridge for a piezoelectric inkjet printer or any other inkjet printer in which it might be desirable to use the new methods. FIG. 1 is a perspective view of cartridge 10. FIG. 2 is a top plan view and FIGS. 3-6 are section views, respectively, of ink cartridge 10. The ink holding foam is cut-away in the top plan section view of FIG. 6 to more clearly illustrate some of the internal features of ink cartridge 10. FIG. 7 is a detail section view of a portion of the printhead in cartridge 10.

Referring to FIGS. 1-7, cartridge 10 includes a printhead 12 located at the bottom of cartridge 10 below an ink holding chamber 14. Printhead 12 includes a nozzle plate 16 with two arrays 18, 20 of ink ejection nozzles 22. In the embodiment shown, each array 18, 20 is a single row of nozzles 22. As shown in the detail view of FIG. 7, firing resistors 24 formed on an integrated circuit chip 26 are positioned behind ink ejection nozzles 22. A flexible circuit 28 carries electrical traces from external contact pads 30 to firing resistors 24. When ink cartridge 10 is installed in a printer, cartridge 10 is electrically connected to the printer controller through contact pads 30. In operation, the printer controller selectively energizes firing resistors 24 through the signal traces in flexible circuit 28. When a firing resistor 24 is energized, ink in a vaporization chamber 32 (FIG. 7) next to a resistor 24 is vaporized, ejecting a droplet of ink through a nozzle 22 on to the print media. The low pressure created by ejection of the ink droplet and cooling of chamber 32 then draws in ink to refill vaporization chamber 32 in preparation for the next ejection. The flow of ink through printhead 12 is illustrated by arrows 34 in FIG. 7.

Ink is held in foam 36 or another suitable porous material in ink chamber 14 formed within a cartridge housing 38. Housing 38, which is typically molded plastic, may be molded as a single unit, molded as two parts (e.g., a cover 40 and a body 42) or constructed of any number of separate parts fastened to one another in the desired configuration. An outlet 44 to printhead 12 is located near the bottom of ink chamber 14. A filter 46 covering outlet 44 is often used to keep contaminants, air bubbles and ink flow surges from entering printhead 12 during operation. Foam 36 is usually compressed around filter 46 and outlet 44 to increase its capillarity in the region of outlet 44. As ink is depleted from foam 36, the increased capillarity near outlet 44 tends to draw ink from all other portions of foam 36 to maximize the amount of ink drawn from chamber 14.

Referring now specifically to FIG. 2, openings 48 and 49 formed in cover 40 are covered by a label or other suitable adhesive sheet 50. Vent openings 48 are exposed to the atmosphere through circuitous tunnels 52. Each tunnel 52, commonly referred to as a labyrinth, is formed by a recess in the top of cover 40 that extends past the edge of label 50. Labyrinths, which are well known in the art of inkjet printing, are commonly used for venting ink cartridges to slow the rate of evaporation.

Figure 8A:
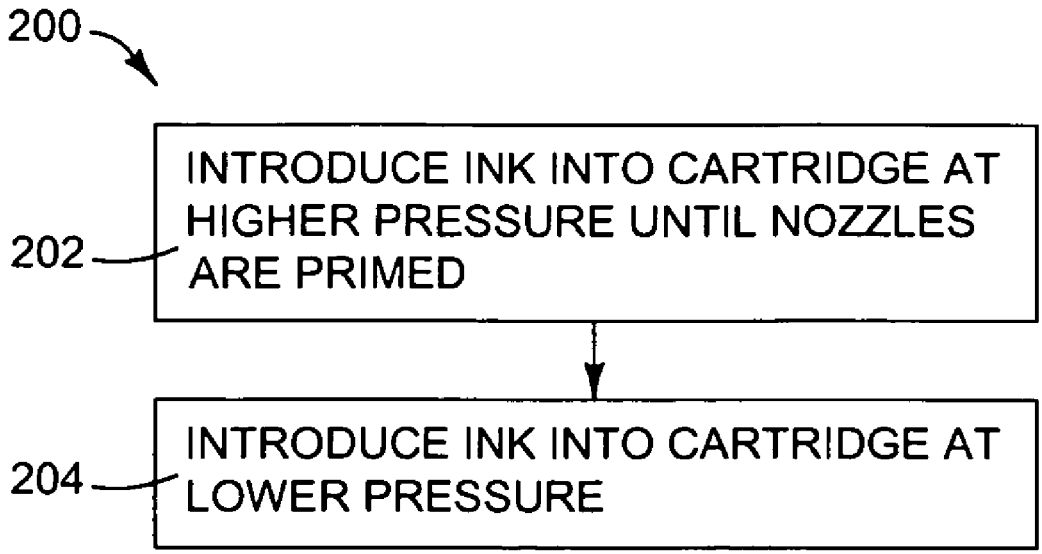
FIGS. 8A and 8B are a flow chart and graph, respectively, illustrating an ink introduction method according to an embodiment of the invention.
Figure 8B:
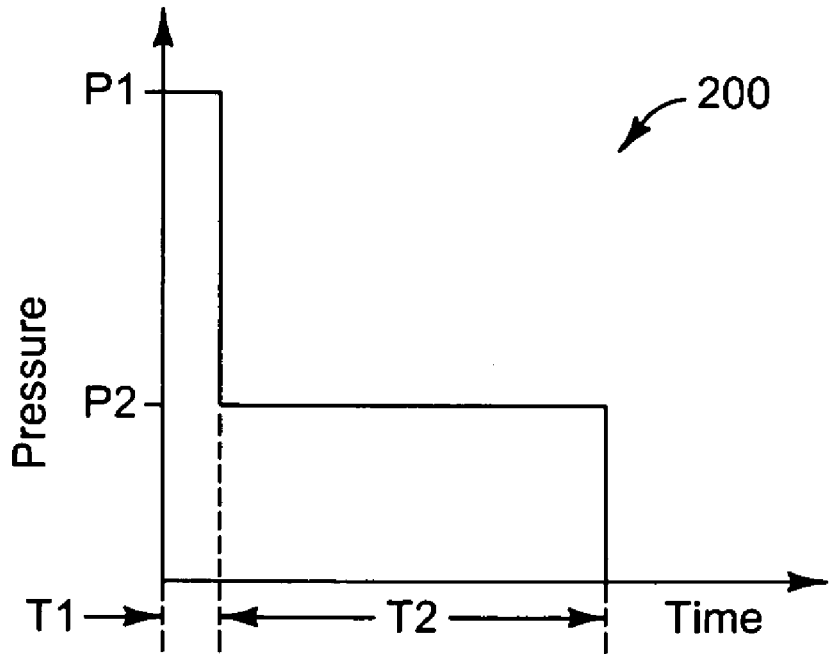

FIGS. 8A and 8B depict an ink introduction method 200 according to one embodiment of the invention. Method 200 will be described with reference to the single color ink cartridge 10 shown in FIGS. 1-7. Referring to FIGS. 8A and 8B, ink is introduced into cartridge 10 through nozzles 22 at a first higher ink pressure P1 (step 202) for a first duration T1 and then at a second lower ink pressure P2 for a second duration T2 (step 204). First pressure P1 and time T1 are selected to enable ink to displace air from printhead 12. The desired pressure P1 and duration T1 for a particular application can be determined routinely by testing a range of applied pressures and durations until a desired air displacement is achieved. Printhead geometry, nozzle diameter, ink viscosity, and surface tension, for example, are factors that may influence the desired pressure P1 and duration T1. In one exemplary embodiment for refilling a used print cartridge, pressure P1 should be sufficient to overcome surface tension forces within cartridge 10 to displace air from the wetted portions of printhead 12. While the actual pressure P1 may vary according to the factors noted above, a pressure P1 of about 3 psi is expected to be sufficient in smaller monochrome print cartridges such as an HP 56 black ink cartridge.

Figure 3:
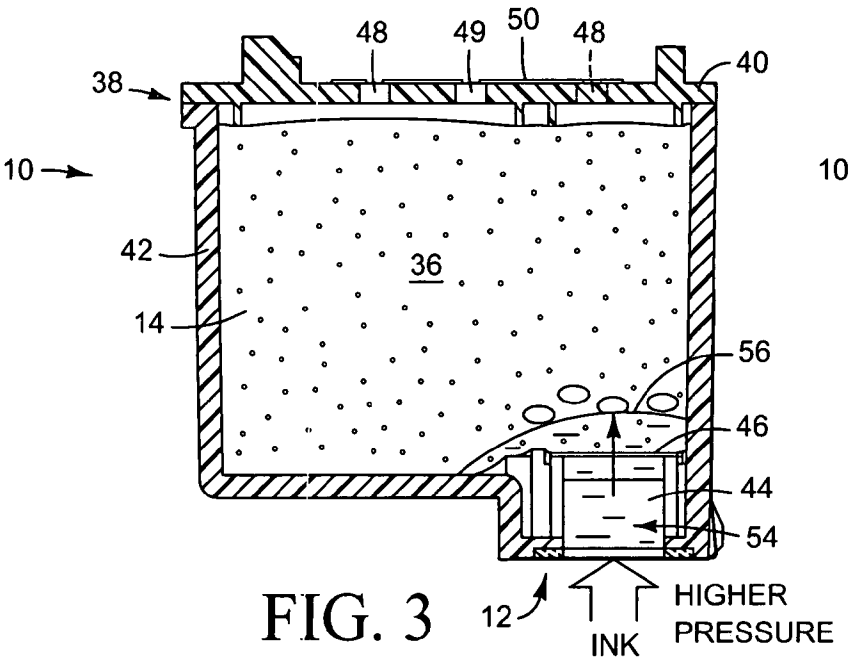
Figure 6:
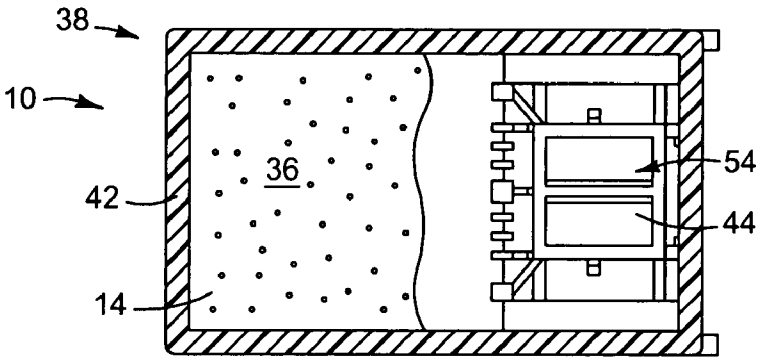
FIG. 6 is a plan section view of the ink cartridge of FIG. 1 taken along the line 6-6 in FIG. 5 with the ink holding foam cut-away to more clearly illustrate some of the internal features of the ink cartridge.

In one exemplary embodiment for introducing ink into a cartridge 10, ink is introduced into cartridge 10 at the higher pressure P1 at least until nozzles 22 are primed with ink and, preferably, until ink fills ink delivery area 54 (FIGS. 3-7) and reaches the bottom of ink chamber 14 and foam 36, as shown by ink level 56 in FIG. 3. Ink delivery area 54 designates the structure between ink chamber 14 and nozzles 22 through which ink can move between chamber 14 and nozzles 22. "Prime" as used in this document means displacing sufficient air from the ink chamber, ink delivery area, nozzles and/or other regions of the printhead in a cartridge such that any remaining air bubbles will not degrade print quality. Nozzles 22 in cartridge 10 are primed, therefore, when ink has displaced sufficient air from the operative portions of printhead 12 such that any remaining air will not degrade print quality for cartridge 10. Although FIG. 8B depicts constant pressure P1 throughout duration T1, pressure P1 may vary over time as long as it is sufficient to prime nozzles 22 as described above.

Figure 4:
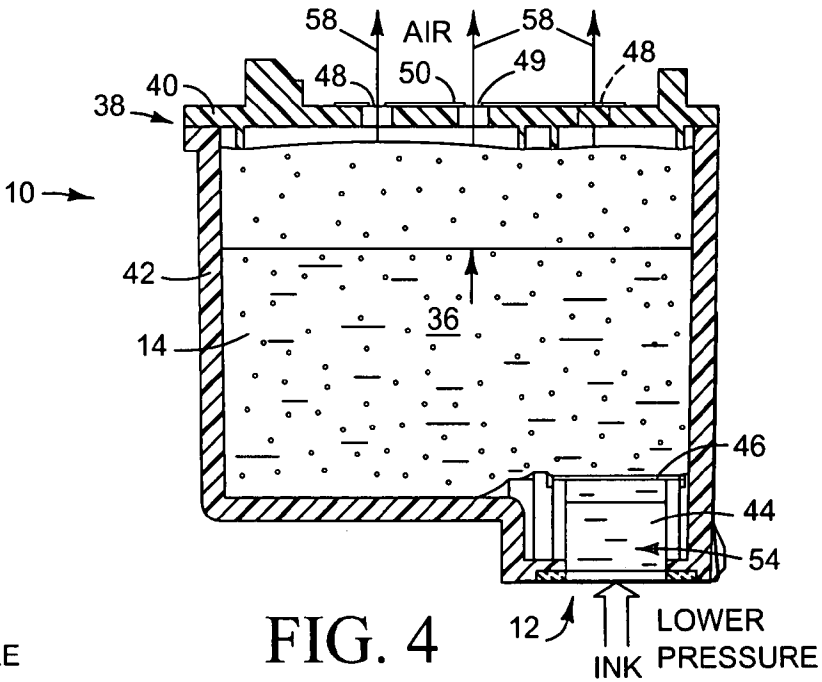
FIGS. 3 and 4 are side elevation section views of the cartridge of FIG. 1 taken along the line 3/4-3/4 in FIG. 2.

Referring again to FIGS. 8A and 8B, following step 202, the applied pressure is reduced to a lower pressure P2 for duration T2 in step 204 until the ink reaches the desired fill level. As shown in FIG. 4, introducing ink into cartridge 10 at a lower pressure P2 helps allow the ink to wick fully into foam 36 without overflowing through openings 48 and 49. It is desirable, therefore, that the second pressure P2 is low enough so that ink introduced into cartridge 10 will saturate substantially all of foam 36 before overflowing ink chamber 14. Although FIG. 8B depicts constant pressure P2 throughout duration T2, pressure P2 may vary over time. Therefore, "pressure" as used in this document means a single pressure applied over a duration of time, a range of pressures applied over the duration, a peak pressure applied over the duration, or an average of varying pressures applied over the duration. For refilling a typical monochrome ink cartridge such as cartridge 10, it is expected that higher pressure P1 in step 202 (or the peak pressure applied in step 202 if a variable pressure) will be at least 50% greater than lower pressure P2 in step 204 (or the average pressure applied in step 204 if a variable pressure). Preferably, higher pressure P1 in step 202 (or the peak pressure applied in step 202 if a variable pressure) is more than twice the lower pressure P2 in step 204 (or the average pressure applied in step 204 if a variable pressure). While the duration T2 of lower pressure step 204 will tend to be greater than the duration T1 of higher pressure step 202, it is expected that the total time for both steps (T1+T2) for a typical cartridge 10 will usually be less than 30 seconds. The two stage method illustrated in FIGS. 8A and 8B helps achieve the dual purposes of removing substantially all of the air from printhead 12 while also allowing for complete filling of ink chamber 14 without also overflowing chamber 14. The new two stage method is particularly advantageous for refilling cartridges that utilize a foam or other wicking agent (e.g., ink holding foam 36) and have a long form factor (i.e., elongated from side to side).

For refilling some used cartridges, it may be desirable to puncture or remove label 50 to expose chamber 14 directly to the atmosphere through openings 48 and 49. While it is expected that label 50 covering all five openings 48 and 49 will be punctured or removed to expose chamber 14 directly to the atmosphere through all openings 48 and 49, as shown in FIGS. 3 and 4, it may be desirable under some circumstances to expose chamber 14 directly to the atmosphere through fewer than all of openings 48 and 49, or to not expose chamber 14 directly to the atmosphere at all (relying on the slow venting through labyrinths 52). Exposing one or more vents 48 directly to the atmosphere allows air to escape ink chamber 14 faster as indicated by arrows 58 in FIG. 4 and may, therefore, allow ink to fill chamber 14 faster.

Figure 10:
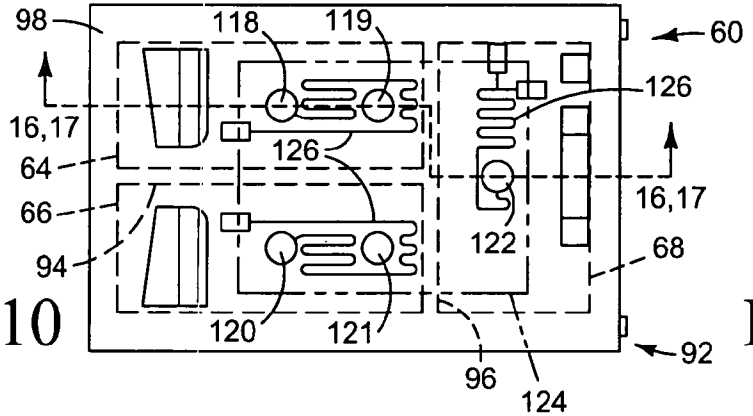
FIG. 10 is a top plan view of the ink cartridge of FIG. 9.

FIGS. 9-15 illustrate a three color ink cartridge 60 for a thermal inkjet printer. FIG. 9 is a perspective view of cartridge 60. FIG. 10 is a top plan view and FIGS. 11-14 are section views, respectively, of ink cartridge 60. The ink holding foam is omitted from the top plan section view of FIG. 11 to more clearly illustrate some of the internal features of ink cartridge 60. FIG. 15 is a detail section view of a portion of the printhead in cartridge 60. Referring to FIGS. 9-15, cartridge 60 includes a printhead 62 located at the bottom of cartridge 60 below ink chambers 64, 66 and 68. Printhead 62 includes a nozzle plate 70 with three arrays 72, 74 and 76 of ink ejection nozzles 78. In the embodiment shown, each array 72, 74 and 76 is a single row of nozzles 78. As shown in FIG. 15, firing resistors 80 formed on an integrated circuit chip 82 are positioned behind ink ejection nozzles 78. A flexible circuit 84 carries electrical traces from external contact pads 86 to firing resistors 80.

When ink cartridge 60 is installed in a printer, cartridge 60 is electrically connected to the printer controller through contact pads 86. In operation, the printer controller selectively energizes firing resistors 80 through the signal traces in flexible circuit 84. When a firing resistor 80 is energized, ink in a vaporization chamber 88 (FIG. 15) next to a resistor 80 is vaporized, ejecting a droplet of ink through nozzle 78 on to the print media. The low pressure created by ejection of the ink droplet and cooling of chamber 88 then draws in ink to refill vaporization chamber 88 in preparation for the next ejection. The flow of ink through printhead 62 is illustrated by arrows 90 in FIG. 15.

Referring now to the section views of FIGS. 10-14, ink is stored in three chambers 64, 66 and 68 formed within cartridge housing 92. Each chamber 64, 66 and 68 may be used to store a different color ink, cyan, magenta and yellow for example. Ink chambers 64, 66 and 68 are separated from one another by partitions 94 and 96. Housing 92, which is typically formed from a plastic material, may be molded as a single unit, molded as two parts (e.g., a cover 98 and a body 100 that includes partitions 94 and 96) or constructed of any number of separate parts fastened to one another in the desired configuration. An outlet 102, 104 and 106 is located near the bottom of each ink chamber 64, 66 and 68, respectively. A conduit 108, 110 and 112 leads from each outlet 102, 104 and 106, respectively. Ink passes from each chamber 64, 66 or 68 through a corresponding outlet 102, 104 or 106 and conduit 108, 110 or 112 to printhead 62, where it is ejected through the corresponding nozzle array 72, 74 or 76, as described above.

Ink is held in foam 114 or another suitable porous material in each ink chamber 64, 66 and 68. A filter 116 covering each outlet 102, 104, and 106 is typically used to keep contaminants, air bubbles and ink flow surges from entering printhead 12 during operation. Foam 114 is usually compressed around filters 116 and outlets 102, 104 and 106 to increase its capillarity in the region of outlets 102, 104 and 106. As ink is depleted from foam 114, the increased capillarity near the outlet tends to draw ink from all other portions of foam 114 to maximize the amount of ink drawn from each chamber 64, 66 and 68.

Referring now specifically to FIG. 10, openings 118, 119, 120, 121 and 122 formed in cover 98 are covered by a label or other suitable adhesive sheet 124. Vent openings 118, 120 and 122 are exposed to the atmosphere through circuitous tunnels 126. Each tunnel 126, commonly referred to as a labyrinth, is formed by a recess in the top of cover 98 that extends past the edge of label 124.

FIG. 18 is a flow chart illustrating an ink introduction method 300 according to one embodiment of the invention. Method 300 will be described with reference to ink cartridge 60 shown in FIGS. 16-17. FIGS. 16-17 are side elevation section views of cartridge 60, similar to FIG. 12, showing ink fill needles 128 and 130. The cross-hatching has been partly removed from the area of conduit 108 in FIG. 16 to better illustrate this area of cartridge 60. Referring first to FIGS. 16 and 18, in step 302, ink is introduced into each ink chamber 64, 66 and 68 simultaneously through a set of three ink fill needles. Only two of the three ink fill needles (needles 128 and 130) are visible in the side view of FIGS. 16-17. Hence, the following description calls out only those parts visible in FIGS. 16-17. It is to be understood, however, that the same actions are performed simultaneously in the ink chamber 66 that is not visible in FIGS. 16-17.

A first higher ink pressure stage of a filling method is depicted in step 302 of method 300 in FIG. 18 and as pressure P1 in FIG. 8B. During step 302, ink chambers 64 and 68 are sealed so that the ink pushes substantially all of the air out of printhead 62 through nozzles 78. For example, if ink flow needles are used as shown in FIG. 16, then once cartridge 60 is placed in the fill/refill device the ink flow needles 128 and 130 are inserted into openings 119 and 122 as shown until a stopper 140, 142 on each needle 128 and 130 contacts and seals each opening 119 and 122. Ink may be introduced into the bottom of each chamber 64 and 68 near outlets 102 and 106, as shown in FIG. 16, to help push air out through nozzles 78. Although the position of the ink fill needles may vary depending on the particular configuration of the ink cartridge, it is expected that positioning the end of each needle 128 and 130 between 1.0 mm and 5.0 mm from filters 102 and 106 will more effectively push air out through nozzles 78 for configurations like those of cartridge 60. Ink is introduced into each chamber 64 and 68 at the higher pressure at least until air is displaced through nozzles 78 and, preferably, until nozzles 78 are primed with ink. It may also be desirable to continue at the higher pressure P1 until ink fills ink delivery areas 134 and 136 (and 132, see FIGS. 12-14) and reaches the bottom of each ink chamber, as shown by ink level 138 in FIG. 16. Each ink delivery area 132, 134 and 136 designates the structure between each ink chamber 64, 66 and 68 and nozzle array 72, 74 and 76 through which ink can move between the ink chambers and the nozzles.

"Seal" as used in this document does not mean completely sealed—all that is necessary is that sufficient pressure can develop in each chamber 64, 66 and 68 during the introduction of ink to push any air trapped in ink delivery areas 132, 134 and 136 out through nozzles 78. For example, although a labyrinth 126 is connected to rear vent openings 118 and 120, the release of air through labyrinths 126 may be slow enough that sufficient pressure might still be developed in chambers 64 and 66 at the higher rate of ink flow to push air out of ink delivery areas 132 and 134 through nozzles 78. As noted above, "prime" as used in this document means displacing sufficient air from the ink chamber, ink delivery area, nozzles and/or other regions of the printhead in a cartridge such that any remaining air bubbles will not degrade print quality. Nozzles 78 in cartridge 60 are primed, therefore, when ink has displaced sufficient air from the operative portions of printhead 62 such that any remaining air will not degrade print quality for cartridge 60. Nozzles 78 are primed, therefore, when ink has displaced sufficient air from the operative portions of printhead 62 such that any remaining air will not degrade print quality for cartridge 60.

Referring now to FIGS. 17 and 18, once air has been displaced through nozzles 78, the applied pressure of ink is reduced as depicted in step 304 and as lower pressure P2 in FIG. 8B. Preferably, ink chambers 64 and 68 are unsealed, by for example, partially withdrawing ink needles 128 and 130 as shown in FIG. 17, and the flow of ink is decreased to a second lower rate in step 304 until the ink reaches the desired fill level. As shown in FIG. 17, introducing ink into chambers 64 and 68 at a lower rate of flow helps allow the ink to wick fully into foam 114 without overflowing through openings 119 and 122. It is desirable, therefore, that the second rate of flow is low enough so that ink introduced into chambers 64 and 68 will saturate substantially all of foam 114 before overflowing chambers 64 and 68. The two stage method illustrated in FIG. 18 helps enable fully automated kiosk refill processing for multi-color ink cartridges while still effectively purging air from the printhead to fully prime the nozzles during the refill method.

In an alternative fill method (not shown), each chamber 64, 66 and 68 is filled separately, allowing the use of just one needle if desired. If each chamber is filled separately, then the opening used to fill one chamber should be resealed prior to filling the next chamber to help prime the nozzles.

FIG. 19 is a flow chart illustrating a method 400 for refilling a used ink cartridge such as single-color cartridge 10 shown in FIGS. 1-7 or multi-color cartridge 60 shown in FIGS. 9-15. In method 400, the quantity of refill ink is determined directly from the ink remaining in each ink chamber. Referring to FIG. 19, in step 402 the quantity of ink remaining in each ink holding chamber is determined and then, in step 404, the desired quantity of refill ink for each chamber is determined based on the difference between the capacity of the chamber and the ink remaining in the chamber. In step 406, each chamber in the cartridge is refilled with the desired quantity of ink computed in step 404 using, for example, one of the ink introduction methods described above.

For ink cartridges that do not utilize an ink holding material, the desired quantity of refill ink should be equal to, or nearly equal to, the difference between the capacity of the chamber and the ink remaining in the chamber determined in step 402. For ink cartridges that utilize an ink holding material, such as foam 36 and 114 in ink cartridges 10 and 60, respectively, a lesser percentage of the difference should be used to refill the chamber to account for decreasing volumetric efficiencies in the ink holding material. For example, the polyurethane foam used in many ink cartridges may lose 20%-25% of its ink holding capacity after it has been used. The quantity of ink used to refill a used "foam" type cartridge chamber, therefore, may be only 75%-80% of the of the difference between the capacity of the chamber and the ink remaining in the chamber.

In one embodiment for step 402, the quantity of ink remaining in each ink holding chamber is determined by measuring the back pressure in the chamber. Backpressure is also sometimes called negative pressure or vacuum. For many types of ink cartridges, the backpressure in an ink chamber increases as the quantity of ink remaining in the chamber decreases. This relationship between backpressure and ink volume, typically defined in backpressure/ink volume curves, is known for many ink cartridges and, in any event, may be established empirically through routine experimentation. Also, the techniques and instrumentation for measuring backpressure in ink cartridges are well known. Hence, measuring backpressure may be one way to effectively and efficiently determine the ink remaining in an ink chamber.

In another embodiment for step 402, the quantity of ink remaining in each ink holding chamber is determined by measuring the remaining ink directly. Any suitable technique may be used. For example, ink fill needles 128 and 130 shown in FIGS. 16 and 17 may be constructed as insulated conductive needles to serve as both inductive ink level sensors and ink fill conduits. The complex impedance of the inductive needles measured as the needles are inserted into the ink chambers indicates the quantity of ink remaining in the chamber. Alternatively, a discrete sensor may be used, and/or using other electronic interrogation (e.g., capacitive, amperometric, or coulometric sensors).

FIG. 20 is a flow chart illustrating a method 500 for refilling a used ink cartridge such as single-color cartridge 10 shown in FIGS. 1-7 or multi-color cartridge 60 shown in FIGS. 9-15. In method 500, the level of ink in each chamber is monitored during refilling. The method of FIG. 20 will be described with reference to ink cartridge 60 shown in FIG. 21. Referring to FIGS. 20 and 21, in step 502, ink is introduced into each ink chamber 64 and 68 through ink fill needles 128 and 130. Simultaneously with introducing ink, the level of ink in each chamber 64 and 68 is monitored, as indicated at step 504. Once the desired ink fill level is reached, ink flow through needles 128 and 130 is ended, as indicated at step 506. For needles 128 and 130 constructed as insulated conductive needles described above, the complex impedance of the inductive needles measured as ink fills each chamber 64 and 68 indicates the ink fill level. Again, as noted above, any suitable sensor may be used to monitor ink fill levels. Meter 144 and a programmable controller 146 in FIG. 21 depict generally output from sensor/needles 128 and 130 used to measure the ink fill levels and control the introduction of ink into chambers 64 and 68.

FIG. 22 is a flow chart illustrating a method 600 for refilling a used ink cartridge such as single-color cartridge 10 shown in FIGS. 1-7. In method 600, the desired quantity of refill ink is determined indirectly based on weight. Referring to FIG. 22, in step 602, the used cartridge is weighed before any refill ink has been added. The difference between the weight of the used cartridge and the weight of a new cartridge filled with ink is determined at step 604. This difference in weight represents the quantity of ink that has been used and, accordingly, reflects the quantity of ink needed to refill the cartridge. In step 606, the desired quantity of ink to refill the cartridge is determined based on the weight difference determined in step 604. Then, in step 608, the cartridge is refilled with the desired quantity of ink determined in step 606 using, for example, one of the ink introduction methods described above.

For ink cartridges that do not utilize an ink holding material, the desired quantity of refill ink should be equal to, or nearly equal to, the difference in weight of ink determined in step 402. For ink cartridges that utilize an ink holding material, such as foam 36 and 114 in ink cartridges 10 and 60, respectively, a lesser percentage of the weight difference should be used to refill the cartridge to account for decreasing volumetric efficiencies in the ink holding material. For example, the polyurethane foam used in many ink cartridges may lose 20%-25% of its ink holding capacity after it has been used. The quantity of ink used to refill a used "foam" type cartridge, therefore, may be only 75%-80% of the of the weight difference between the used cartridge and a new cartridge.

For a single-color ink cartridge, such as cartridge 10 shown in FIGS. 1-7, in which just one ink is held in a single chamber, the quantity of refill ink is directly related to the overall weight difference. The ink remaining in a multi-color ink cartridge, such as cartridge 60 shown in FIGS. 9-15, in which multiple inks are held in different chambers, may be determined from weight measurements at multiple specific points on the body of the cartridge. In the instance that the weight measurements for step 602 in FIG. 22 are taken at locations corresponding to the center of mass of each ink chamber, the desired quantity of refill ink in step 606 may be determined directly based on the difference in step 604 between the weights of the used cartridge and the corresponding weights of a new cartridge. In other instances, in which the weight measurements are taken at points other than at each center of mass, linear equations (summation of torques about axes, for example) may be used to determine the desired quantity of refill ink for each chamber. The above method may be used with multi-color ink cartridges having fewer than four ink chambers and in which the centers of mass for the ink chambers are not aligned co-linearly with one another.

The present invention has been shown and described with reference to the foregoing exemplary embodiments. It is to be understood, however, that other forms, details and embodiments may be made without departing from the spirit and scope of the invention which is defined in the following claims.

What is claimed is:

1. A method for refilling a used ink cartridge, comprising:

determining a quantity of ink remaining in an ink holding chamber in the cartridge;

determining a desired quantity of ink to refill the chamber based on a difference between a capacity of the chamber and the quantity of ink remaining in the chamber; and refilling the chamber with the desired quantity of ink, wherein the used ink cartridge includes ink holding material in the ink holding chamber and determining a desired quantity of ink to refill the chamber based on a difference between a capacity of the chamber and the quantity of ink remaining in the chamber includes accounting for a decreased capacity of the ink holding material in the used cartridge compared to a capacity of the ink holding material in a new cartridge.

2. The method of claim 1, wherein determining a desired quantity of ink to refill the chamber based on a difference between a capacity of the chamber and the quantity of ink remaining in the chamber comprises determining the desired quantity of ink to be substantially the entire difference between the capacity of the chamber and the quantity of ink remaining in the chamber.

3. The method of claim 1, wherein determining a desired quantity of ink to refill the chamber based on a difference between a capacity of the chamber and the quantity of ink remaining in the chamber comprises determining the desired quantity of ink to be 75%-80% of the difference between the capacity of the chamber and the quantity of ink remaining in the chamber.

4. The method of claim 1, wherein determining a quantity of ink remaining in an ink holding chamber in the cartridge comprises measuring a backpressure in the chamber and determining the quantity of ink remaining in the chamber based on the backpressure.

5. The method of claim 1, wherein determining a quantity of ink remaining in an ink holding chamber in the cartridge comprises measuring the quantity of ink remaining in the chamber.

6. A method for refilling a used ink cartridge, comprising: introducing ink into an ink holding chamber in the cartridge; simultaneously with introducing ink into the chamber, monitoring the level of ink in the chamber; and ending the introduction of ink into the chamber when the level of ink in the chamber reaches a desired level; wherein: introducing ink into an ink holding chamber in the cartridge comprises inserting a needle into the chamber and introducing ink into the ink holding chamber through the needle; and monitoring the level of ink in the chamber comprises monitoring the level of ink in the chamber through the needle.

7. A method for refilling a used ink cartridge, comprising:

determining a quantity of ink remaining in an ink holding chamber in the cartridge;

determining a desired quantity of ink to refill the chamber based on a difference between a capacity of the chamber and the quantity of ink remaining in the chamber;

introducing a first quantity of ink into the chamber at a first pressure; and then introducing a second quantity of ink into the chamber at a second pressure lower than the first pressure until the desired quantity of ink has been introduced into the chamber.

8. The method of claim 7, wherein the cartridge includes a printhead operatively coupled to the ink holding chamber and the first pressure is sufficient to displace air from the printhead.

9. The method of claim 8, wherein the printhead includes ink ejection nozzles and introducing a first quantity of ink into the chamber at a first pressure comprises introducing the first quantity of ink into the chamber at the first pressure through the ink ejection nozzles.

10. The method of claim 7, wherein the cartridge includes an ink holding material in the ink holding chamber and the second pressure is low enough so that ink introduced into the chamber at the second pressure will saturate substantially all of the ink holding material before overflowing the chamber.

11. A method for refilling a used ink cartridge, comprising:

introducing a first quantity of ink into the chamber at a first pressure; then introducing a second quantity of ink into the chamber at a second pressure lower than the first pressure;

simultaneously with introducing the second quantity of ink into the chamber, monitoring the level of ink in the chamber; and ending the introduction of ink into the chamber when the level of ink in the chamber reaches a desired level.

12. The method of claim 11, wherein:

introducing a second quantity of ink into the chamber at a second pressure lower than the first pressure comprises inserting a needle into the chamber and introducing the second quantity of ink into the chamber through the needle; and monitoring the level of ink in the chamber comprises monitoring the level of ink in the chamber through the needle.

13. A method for refilling a used ink cartridge, comprising:

weighing the used cartridge;

determining a difference between the weight of the used cartridge and a weight of a new cartridge;

determining a desired quantity of ink to refill the chamber based on the difference between the weight of the used cartridge and the weight of a new cartridge;

introducing a first quantity of ink into the chamber at a first pressure; and then introducing a second quantity of ink into the chamber at a second pressure lower than the first pressure until the desired quantity of ink has been introduced into the chamber.

14. A method for refilling a used ink cartridge, comprising:

determining a quantity of ink remaining in an ink holding chamber in the cartridge;

determining a desired quantity of ink to refill the chamber based on a difference between a capacity of the chamber and the quantity of ink remaining in the chamber; and refilling the chamber with the desired quantity of ink, wherein determining a quantity of ink remaining in an ink holding chamber in the cartridge comprises measuring the quantity of ink remaining in the chamber.

* * * * *